US009899717B2

(12) United States Patent
Bedinger et al.

(10) Patent No.: US 9,899,717 B2
(45) Date of Patent: Feb. 20, 2018

(54) STACKED LOW LOSS STRIPLINE CIRCULATOR

(71) Applicant: RAYTHEON COMPANY, Waltham, MA (US)

(72) Inventors: John M. Bedinger, Garland, TX (US); Sankerlingam Rajendran, Plano, TX (US)

(73) Assignee: RAYTHEON COMPANY, Waltham, MA (US)

( * ) Notice: Subject to any disclaimer, the term of this patent is extended or adjusted under 35 U.S.C. 154(b) by 0 days.

(21) Appl. No.: 14/881,853

(22) Filed: Oct. 13, 2015

(65) Prior Publication Data

US 2017/0104256 A1 Apr. 13, 2017

(51) Int. Cl.

| | |
|---|---|
| ***H01P 1/387*** | (2006.01) |
| ***H01P 1/38*** | (2006.01) |
| ***H01F 7/02*** | (2006.01) |
| ***H01P 11/00*** | (2006.01) |

(52) U.S. Cl.
CPC ..... *H01P 1/38* (2013.01); *H01F 7/02* (2013.01); *H01P 1/387* (2013.01); *H01P 11/00* (2013.01)

(58) Field of Classification Search
CPC ..... H01P 1/387
USPC ..... 333/1.1, 24.2
See application file for complete search history.

(56) References Cited

U.S. PATENT DOCUMENTS

| | | | |
|---|---|---|---|
| 3,286,201 | A | 11/1966 | Roberts |
| 3,758,878 | A | 9/1973 | Wainwright |
| 4,122,418 | A | 10/1978 | Nagao |
| 4,276,522 | A | 6/1981 | Coerver |
| 4,791,389 | A | 12/1988 | Wolfert |
| 4,810,979 | A | 3/1989 | Morz et al. |
| 5,185,587 | A | 2/1993 | Kurian et al. |
| 5,347,241 | A | 9/1994 | Panaretos et al. |
| 5,898,346 | A | 4/1999 | Kamei et al. |
| 6,633,205 | B2 | 10/2003 | Jussaume et al. |
| 6,822,524 | B2 | 11/2004 | Hempel et al. |
| 6,844,789 | B2 | 1/2005 | Lombardi et al. |
| 7,382,209 | B2 | 6/2008 | Watanabe |

(Continued)

FOREIGN PATENT DOCUMENTS

| | | |
|---|---|---|
| JP | 2002009508 | 1/2002 |

OTHER PUBLICATIONS

Notification of Transmittal of the International Search Report and the Written Opinion of the International Searching Authority, or the Declaration, PCT/US2016/035747, dated Aug. 31, 2016, 1 page.

(Continued)

*Primary Examiner* — Stephen E Jones
(74) *Attorney, Agent, or Firm* — Daly, Crowley, Mofford & Durkee, LLP

(57) ABSTRACT

A stacked stripline circulator includes a first ferrite disc, a second ferrite disc, a first substrate having a metalized edge with the first ferrite disc disposed in the first substrate, a second substrate having a metalized edge with the second ferrite disc disposed in the second substrate, a first metalized pattern defining ports of a circulator disposed on the first substrate, the first metalized pattern comprising copper, a second metalized pattern defining ports of a circulator disposed on the second substrate, the second metalized pattern comprising copper, and a bonding ring bonding the metalized edge of the first substrate with the metalized edge of the second substrate.

26 Claims, 9 Drawing Sheets

(56) References Cited

U.S. PATENT DOCUMENTS

| | | | |
|---|---|---|---|
| 7,385,454 | B2 | 6/2008 | Kingston et al. |
| 7,495,521 | B2 | 2/2009 | Chen et al. |
| 9,136,572 | B2 | 9/2015 | Carr et al. |
| 2002/0135434 | A1 | 9/2002 | Emanuelsson |
| 2006/0226924 | A1 | 10/2006 | Chen et al. |
| 2008/0012779 | A1 | 1/2008 | Chen et al. |
| 2011/0068877 | A1 | 3/2011 | Chawla et al. |
| 2011/0193649 | A1 | 8/2011 | Popelka et al. |
| 2015/0028961 | A1 | 1/2015 | Carr et al. |

OTHER PUBLICATIONS

International Search report, PCT/US2016/035747, dated Aug. 31, 2016, 5 pages.

Written Opinion of the International Searching Authority, PCT/US2016/035747, dated Aug. 31, 2016, 13 pages.

Thin Film High Density htegration (HDI) Design Guidelines, Vishay Intertechnology, Inc., dated Jun. 29,2005, 12 pages.

PCT International Search Report and Written Opinion of the ISA dated Sep. 26, 2014; For PCT Pat. App. No. PCT/US2014/037441; 14 pages.

Bosma; "On Stripline Y-Circulation at UHF," IEEE Transactions on Microwave Theory and Technique, Jan. 1964; pp. 61-72.

Fay et al.; "Operation of the Ferrite Junction Circulator;" IEEE Transactions on Microwave Theory and Techniques, Jan. 1964; pp. 15-27.

Maiti et al.; "Fabrication of Nonreciprocal Microwave Components Using Thick Film Ferrimagnetic Pastes," Electrocomponent Science and Technology, 1981, vol. 8; pp. 111-114.

Simon; "Broadband Strip-Transmission Line Y-Junction Circulators;" IEEE Transactions on Micrwave Theory and Techniques, May 1965; pp. 335-345.

STACKED LOW LOSS STRIPLINE CIRCULATOR

FIELD OF THE INVENTION

This disclosure relates generally to radio frequency (RF) packages and circulators andmore particularly to a stacked low loss stripline circulator and fabrication.

BACKGROUND

As is known in the art, feed structures are used to couple a radar or communication system to an array of antenna elements. One component of a feed structure is a circulator. U.S. patent application Ser. No. 13/952,020 entitled "Dual Stripline Tile Circulator Utilizing Thick Film Post-Fired Substrate Stacking", which is incorporated by reference, describes a dual stacked stripline circulator that includes multiple composite ferrite discs, each having an inner portion and an outer portion; a first substrate having an edge with a first composite ferrite disc disposed in the first substrate; a second substrate having an edge with a second composite ferrite disc disposed in the second substrate; a third substrate having an edge with a third composite ferrite disc disposed in the third substrate, the third substrate disposed adjacent the second substrate; a fourth substrate having an edge with a fourth composite ferrite disc disposed in the fourth substrate; a first pattern defining three ports of a first three-port circulator disposed between the first substrate and the second substrate; a second pattern defining three ports of a second three-port circulator disposed between the third substrate and the fourth substrate; and a metal film encircling the edge of the first, second, third and fourth substrate. The teachings of U.S. patent application Ser. No. 13/952,020 describe the advantages of such a configuration.

SUMMARY

In accordance with the present disclosure, a stacked stripline circulator includes a first ferrite disc, a second ferrite disc, a first substrate having a metalized edge with the first ferrite disc disposed in the first substrate, a second substrate having a metalized edge with the second ferrite disc disposed in the second substrate, a first metalized pattern defining ports of a circulator disposed on the first substrate, the first metalized pattern comprising copper, a second metalized pattern defining ports of a circulator disposed on the second substrate, the second metalized pattern comprising copper, and a bond ring bonding the metalized edge of the first substrate with the metalized edge of the second substrate. The first and second metalized pattern could be made of Ag or Au and includes resonator and matching network metallization that terminate at via pads. The first and second substrates have RF and ground via connections through the substrate. The mirrored metallization first and second substrates are bonded together with solder at selected location or all across the metalized surface. With such an arrangement, a reliable reproducible performance, high power, low loss stripline circulator is fabricated using unique thin film processing techniques. It should be appreciated the bonding ring can be a solder ring or compression bonding, diffusion bonding or adhesive bonding or other similar techniques can be used to bond the first substrate with the second substrate.

In at least one embodiment, the stacked stripline circulator includes a plurality of solder balls disposed between the first metalized pattern and the second metalized pattern. In another embodiment, solder is plated (or screen printed) across the entire first and second metalized pattern. AuSn and/or Pb/Sn among other solders could be used. In yet another embodiment, the substrate metallization includes only Cu, commercially available CuSn Ormet paste is screen printed on appropriate locations of the metalized pattern and both the substrates are bonded through transient liquid phase sintering of Ormet paste and electroless Ni/Au is plated on the external surface for corrosion protection. Furthermore, the stacked stripline circulator may include a plurality of mechanical spacers disposed between the first substrate and the second substrate to control the bond line thickness to assure reproducible good electrical performance and mechanical reliability. Also, the stacked stripline circulator may include a plurality of copper filled vias with glass encircling the copper or bore coated thick film conductor filled with Cu nano paste or Ormet paste.

In accordance with the present disclosure, a dual stacked stripline circulator includes a plurality of ferrite discs, a plurality of substrates, each substrate having a metalized edge with a corresponding ferrite disc disposed in the substrate, a first metalized pattern comprising copper defining three ports of a first three-port circulator disposed between a first substrate and a second substrate, and a second metalized pattern comprising copper defining three ports of a second three-port circulator disposed between a third substrate and a fourth substrate, and a bonding ring encircling a respective edge of the first, second, third and fourth substrate. With such an arrangement, a dual stacked stripline circulator is provided suitable for use with a dual polarized active electronically scanned array (AESA) antenna where each radiating element is being actively fed.

A method of providing a stacked stripline circulator includes forming a first substrate with a first metalized pattern and a metalized edge using copper and a first ferrite disc; forming a second substrate with a second metalized pattern and a metalized edge using copper and a second ferrite disc; disposing a solder ring around the edge of the first substrate and the second substrate; stacking the first substrate and the second substrate with the metalized pattern of the first substrate aligned with the metalized pattern of the second substrate; and heating the solder ring to attach the edge of the first substrate to the second substrate. With such a technique, a stacked stripline circulator is provided compact in size and suitable for use in a feed arrangement for an antenna feed with active elements.

The details of one or more embodiments of the disclosure are set forth in the accompanying drawings and the description below. Other features, objects, and advantages of the disclosure will be apparent from the description and drawings, and from the claims.

DESCRIPTION OF DRAWINGS

Like reference symbols in the various drawings indicate like elements.

DETAILED DESCRIPTION

It should be appreciated that an active electronically scanned array (AESA) antenna requires a circulator component connected to each radiating element. The circulator duplexes the signals from the antenna, routing the transmit signal to the radiating element and the receive signal from the radiating element, while providing isolation between the transmit path and the receive path. As AESA antennas become more common, it is desirable to drive the loss lower and the costs of such antennas down and providing a lower cost circulator for use in an AESA antenna is desirable.

Figure 1:
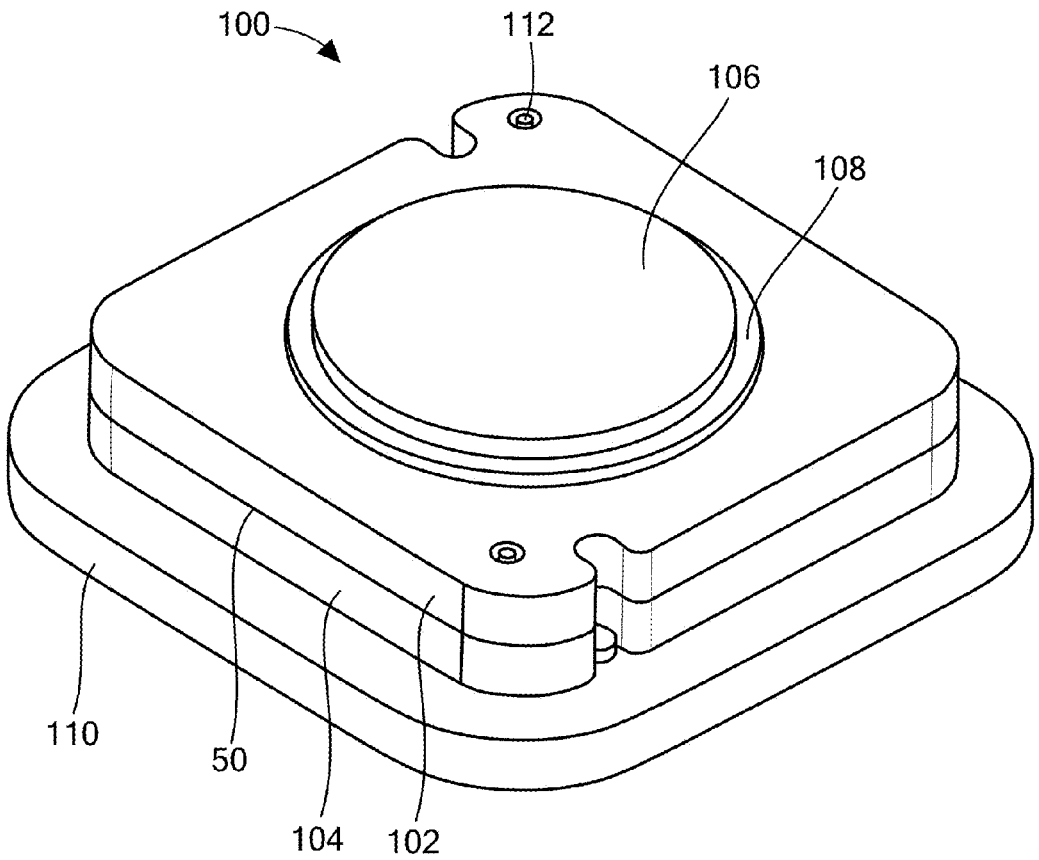
FIG. 1 is a top perspective view of a stacked stripline circulator according to the disclosure.
Figure 2:
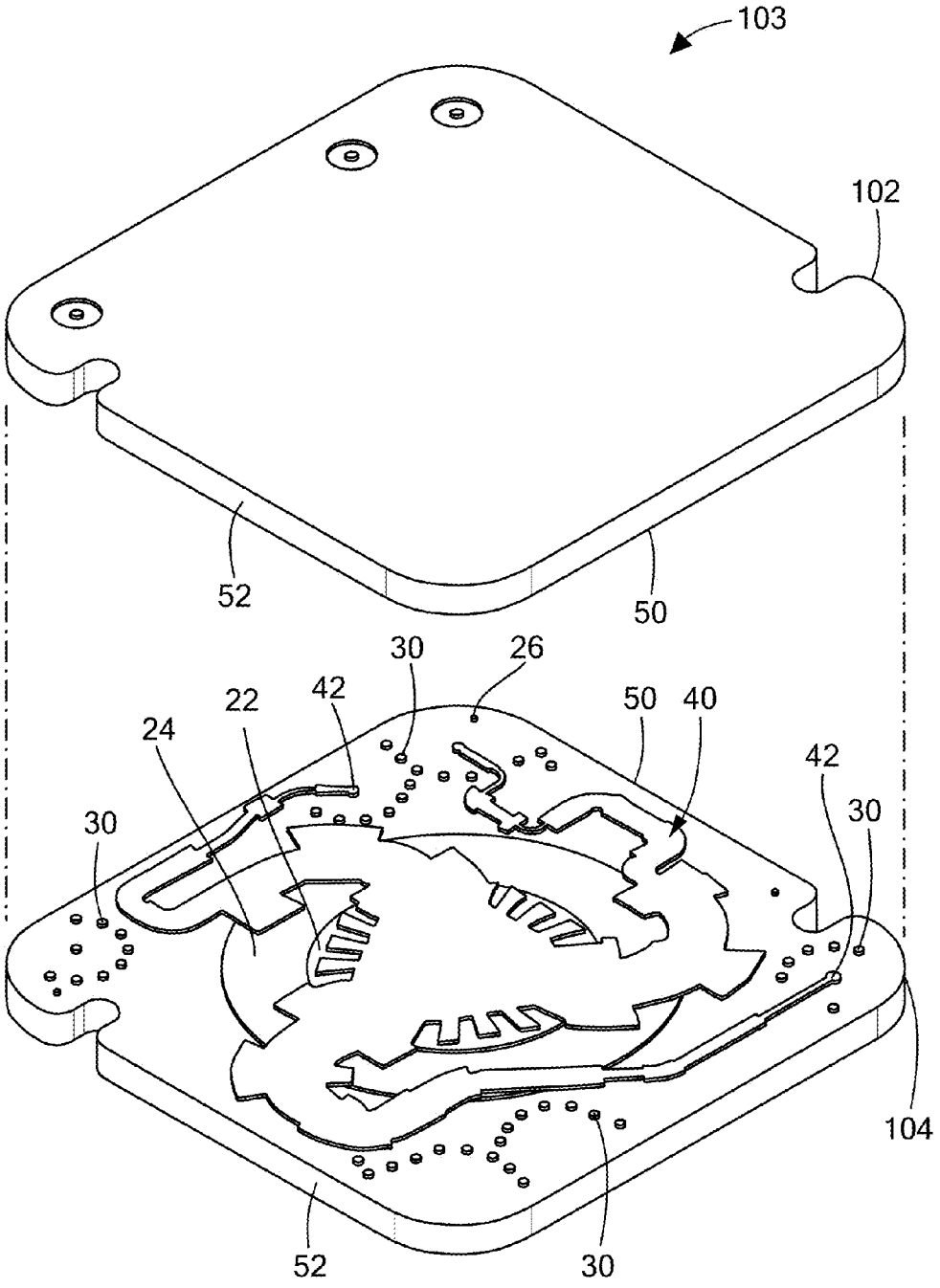
FIG. 2 is a side perspective view of a portion of a stacked stripline circulator according to the disclosure.

Referring now to FIGS. 1 and 2, a stacked stripline circulator 100 is shown where the stacked stripline circulator 100 includes two substrates, substrate 102 and substrate 104 to provide a stacked substrate assembly 103. A pole piece 108 is attached to substrate 102. A magnetic bias is provided by a magnetic pole piece 108 and permanent magnet 106 on top of the stacked substrate assembly 103. In a like manner, a magnetic pole piece (not shown) and permanent magnet (not shown) may be disposed on the bottom of the stacked substrate assembly 103. A cold plate 110 may be attached to the substrate 104 with the provision for input and output ports. The interconnections between the circulators and the T/R modules (not shown) on the bottom and the circulators and the antenna radiators (not shown) on top are made using coaxial spring probe contacts to provide RF ports 112. The stacked stripline circulator 100 has coaxial to stripline vertical transitions formed using via 30 through the substrate to be described further hereinafter and a metallization layer 40 (also referred to as a metalized pattern layer) as shown in FIG. 2 within the stacked substrate assembly 103 and connected with RF ports 42. Unlike the teachings of the above mentioned U.S. patent application where the substrates are bonded together using a thick film sealing glass paste, here the substrates are bonded at a reduced temperature (<320 degree C.) instead of a thick film firing temperature of 850 degree C. which eliminates fabrication issues associated with coefficient of thermal expansion (CTE) with composite substrates with multiple materials. Vias 30 are formed in each substrate layer individually and then connected together when the stacked substrate assembly 103 is bonded together. A metalized pattern layer 40 (also referred to as a metallization layer 40) is pattern plated with low resistivity Cu, a barrier layer such as Ni, Pd or Pt and protective thin Au layer and then connected together using solder balls 44 (FIG. 3C) and fired. The plating chemistry is chosen such that the resistivity of plated copper conductor approaches that of bulk copper (1.67 microohm-cm) to realize low loss in RF circuits including the circulator. Commercially available MICROFAB CU MSA 100 MU was used to realize low resistivity Cu conductor. The metallization layer 40 on substrate 102 is a mirrored pattern of the metallization layer 40 on substrate 104. Grounds are connected together on the outside of the stacked substrate assembly 103 using a solder attachment ring 50 as to be described.

To provide wideband circulators with a bandwidth greater than 2:1, composite ferrite substrates are typically used. These substrates include a center disc of one ferrite material having a high saturation magnetization material and a ring of another ferrite material having a lower saturation magnetization material surrounding the center disc, and a thermally coefficient of thermal expansion (CTE) and electrically dielectric constant matched substrate material surrounding the ferrite materials. The matched substrate material can either be of any ceramic material including titanate, garnet, ferrite, BeO, alumina or other substrate material. It should be noted that the low saturation magnetization material, with Curie temperature less than the circulator operating temperature, could also be used as the matched substrate material. The unique aspects of the processes and materials employed in this disclosure to realize a low loss and low cost high power circulator in a small foot print are: a thin-film copper metalized edge of the substrate is also provided when resonator and ground plane metallization is formed on the two surfaces of the substrate; bond line thickness is controlled with precise stand-off using a mechanical spacer to reduce variability in performance; solder is used to stack and connect the substrate and no separate edge metallization forming step is needed; a solder ring around the edge is used to connect the substrates together and also interconnects ground planes on multiple substrates together through edge metallization. It should be appreciated instead of using the solder ring, compression bonding, diffusion bonding or adhesive bonding or other similar techniques can be used to bond the first substrate with the second substrate.

Referring now to FIG. 2, a substrate 104 is shown where a dual composite disc 22 (or disc 22) includes an inner central portion of high saturation magnetization material and an outer portion of low saturation magnetization material encircling the central inner portion and a substrate material 26 encircling the outer portion of the dual composite disc 22 as shown. The substrate material 26 can either be a garnet, ferrite or other ceramics including titanates, alumina, BeO substrate material. One technique to fabricate the substrate layer 104 as shown is to start with a block of dielectric material and drill out a hole and fill the hole with a low saturation magnetization material using a high temperature adhesive between the two materials. Once the low saturation magnetization material is bound to the substrate material, drill out a smaller hole in the low saturation magnetization material and fill the hole with high saturation magnetization material using a high temperature adhesive between the two materials. Once the high saturation magnetization material is bound to the low saturation magnetization material, the block can be sliced to the desired thickness and then ground to the final thickness to provide the substrate layer 104. Thru-holes are drilled through the dielectric material 26 as required and filled with copper (Cu) with a glass coating to provide metalized thru-holes or vias 30 to correspond to the circuitry as described further herein. Vias could be filled with bore coated with low resistivity Cu paste, such as Heraeus CL 81-10562 followed by filling with low shrinkage Ormet paste 805 or CS510A. Alignment holes or other alignment provisions are also provided in each one of the substrates to facilitate alignment as the substrates are stacked on each other. A metallization layer 40 is shown where a copper conductor layer was sputter deposited on the surface of the substrate 104 on both the front and backside as well as the edges and then a photo resist is applied, developed and pattern plated on the front to provide the desired metallization pattern as shown in FIG. 2. It should be noted the backside of the substrate layer 104 is primarily a ground plane with openings disposed to accommodate the vias 30. The latter is performed for each of the substrates 102 and 104 where the desired metallization pattern is formed on one side of the substrate layer and a ground plane with openings disposed to accommodate the vias 30 on the other side of the substrate layer. It should be appreciated desired metallization pattern is a mirror image of each other for substrates 102 and 104. The requisite metallization pattern needed to fabricate each of the circulators is well known in the art and will depend on the frequency and bandwidth requirements of the application. The technique used to fabricate the stacked stripline circulator 100 is not dependent on any specific metallization pattern and any known metallization pattern used for y-junction circulators may be used. A metalized edge layer 52 is disposed on the outer edge of substrate 102 and substrate 104 and a solder attachment ring 50 is disposed around the edge of the resonator side of each of substrate 102 and substrate 104 and connects the ground plane on the backside through the edge metallization and which is also used to attach the substrate 102 with substrate 104 as described further hereinafter. Also shown in FIG. 1 is an RF port 112 which extends through the substrate and is connected to metallization pattern 40 to provide a signal path.

Having described the elements of the stacked stripline circulator 100, it should be appreciated a reliable reproducible performance, high power, low loss stripline circulator is described. High power and low loss requirements are met with low resistivity & low loss Cu metallization whose thickness can be readily varied with pattern plate technique (instead of plate and etch technique). The described stripline circulator configuration requires bonding of two metalized resonator substrates with good ground connection between the two substrates. To facilitate good grounding connection between the stripline ground planes, a thin film conductor fabrication process is used to metallize all six sides of the substrate with solder compatible metallization. The conductor metallization is terminated with solder compatible Cu/Ni/Au or Cu/Pt/Au metallization. Conductor metallization fabricated with Ag or Au could also be used. The solder attachment ring 50 (sometimes referred to as conductor seal ring 50) formed around the metallization surface of the substrate 102 and substrate 104 connects the ground plane fabricated on the bottom surface of the substrate through the edge metallization. The latter provides a hermetic seal where the solder dispensed on the outer ring flows together and forming a continuous solder ring bonding the two substrates. The two substrates, substrate 102 and substrate 104, with the required vias and mirrored metallization with solder mask are fabricated using appropriate known thin film fabrication techniques. Solder is dispensed on the substrate with screen printing or with a solder ball dispense tool or electroplated. A large area solder connection facilitated by thin layer (approximately 10 microns thick) of plated solder can be used. A stand-off using mechanical spacers to control the bond line thickness is formed on one of the substrates. Solder is dispensed on the seal ring formed around the edge of the metallization surface, the resonator, the matching network, RF signal pad and coaxial ground via. Specifically, the solder paste with the flux can be dispensed on one or both substrates, reflowed and cleaned before bonding the substrates together. The mirrored patterns on the substrate are aligned to each other in a pick and place tool with temporary tacking and then reflowed. With the solder bonding of the two substrates, the resonator metallization, the matching network, the via connections and the solder attachment ring on both substrates are connected with solder. The solder attachment ring ensures connection between the two ground planes of the stripline. A reliable solid filled high aspect ratio via is needed for consistent performance of devices and high yielding thin film resonator fabrication. High aspect ratio Dumet or a copper (Cu) filled via are formed with glass to metal seal process. Selecting materials with appropriate CTE ensures good via connection through the substrate with hermetic or semi-hermetic via seal. Dumet or Copper wire and soda lime glass can be used to form a conductive via connection and seal around the via through garnet and titanate substrate. Alternate method of filling the via is to bore coat the via with Cu paste and fill it with Cu nano paste or Ormet paste.

Figure 3A:
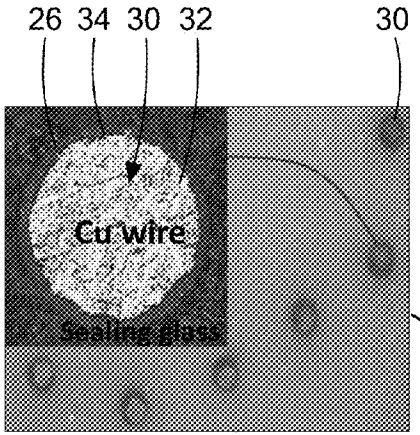
FIGS. 3A to 3C are top perspective views of portions of the stacked stripline circulator during fabrication according to the disclosure.
Figure 3B:
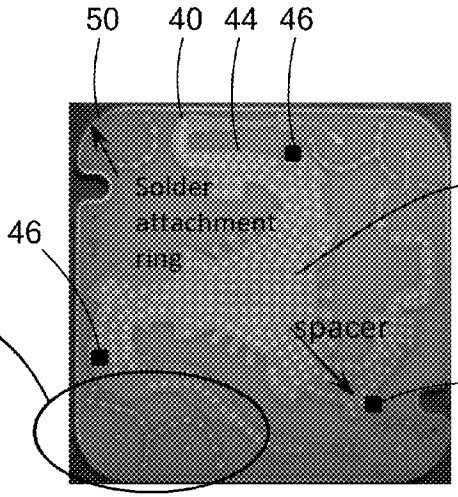
Figure 3C:
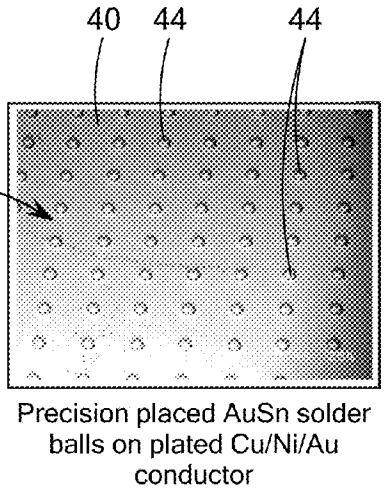
Figure 3D:
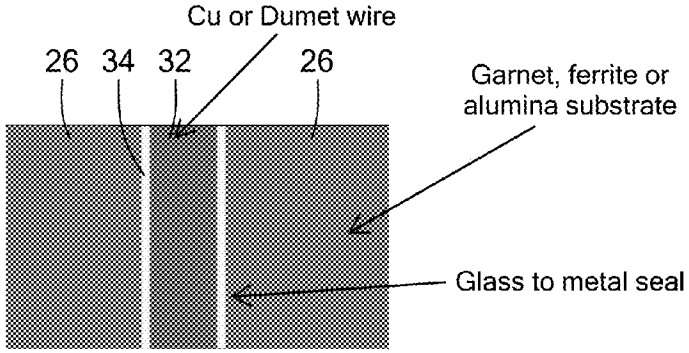
FIG. 3D is a side view of a via in the stacked stripline circulator according to the disclosure.

Referring now to FIGS. 3A to 3C, a more detailed view of the metallization layer 40 disposed on the substrate material 26 is shown. A hermetic via 30 is formed through the substrate material 26 as shown. Referring now also to FIG. 3D, a copper wire 32 having an appropriate diameter is disposed within a hole formed in the substrate material 26. A glass dielectric 34 is provided on an outer surface of the copper wire 32 to bond the copper wire 32 to the substrate material 26. Alternatively, instead of using a copper wire, a Dumet wire can be used. Dumet wire is a copper clad on a core wire (e.g. Nickel-Iron) where the copper cladded wire is welded to achieve an endless length and drawn to obtain the needed diameter. The surface of the Dumet is treated by borating, oxidizing or nickel-plating the surface to ensure a good adhesion to the glass to get the vacuum tight glass-to-metal seal. It should be noted that either copper wire or Dumet wire can be used for vias 30, or alternatively a combination of copper wire and Dumet wire can be used to provide the vias 30. Yet another method of providing a via connection is to bore coat the via with low resistivity Cu paste and fill it with low shrinkage Ormet paste 805 or CS510A. Any excess metal and the dielectric seal is polished to realize a smooth surface for resonator metallization. The hermetic via 30 provides protection from any condensation formed when the stacked stripline circulator 100 is powered down.

Referring now more specifically to FIG. 3B, the metallization layer 40 is provided by a solderable metallization Cu/Ni/Au alloy or Cu/Pt/Au alloy that provides low loss and is a highly conductive thick Cu metallization that spreads and dissipates the heat generated in the stacked stripline circulator 100. Solder balls 44, here comprised of AuSn material, are disposed on the metallization layer 40. The solder balls 44 are placed throughout the metallization layer 40 as shown to connect the metallization layer 40 in substrate layer 102 with the metallization layer 40 in substrate layer 104. A mechanical spacer 46 is used to control the bond-line thickness. As shown, a spacer 46 is disposed, here, at three locations to control the bond-line thickness when substrate layer 102 is matched with substrate layer 104. A solder attachment ring 50 connects the ground plane on the backside through the edge metallization. Solder is dispensed on the solder attachment ring and two mirrored substrates are bonded when the metallization layer 40 in substrate layer 102 is connected with the metallization layer 40 in substrate layer 104 when heated. An alternate method is to screen print solder paste with flux on one or both substrates in the required region, reflow solder and clean the residue before bonding the substrates together. The edge metallization connects the ground planes on the backside of the two substrates and provides grounding for the coaxial connection. It should now be appreciated the substrate metallization fabrication technique, the precision solder ball placement on the metallization and the substrate bonding while controlling the bond line thickness results in a strip-line circulator with coaxial feed through the substrate. Furthermore, fabricating the device at reduced temperature (<350 degree C.) instead of thick film firing temperature of 850 degree C. eliminates fabrication issues associated with CTE with composite substrates with multiple materials. The disclosed circulator supports high power with lower loss, provides better thermal dissipation of heat with Cu metallization and potentially runs cooler.

Figure 4:
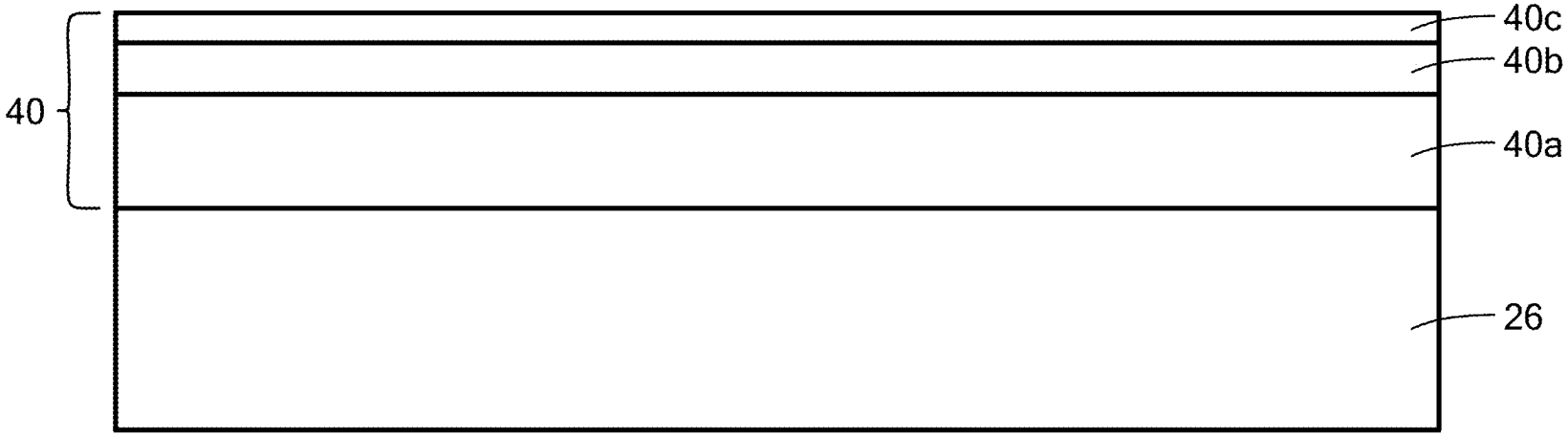
FIG. 4 is a cross sectional view of a portion of the stacked stripline circulator according to the disclosure.
Figure 4A:
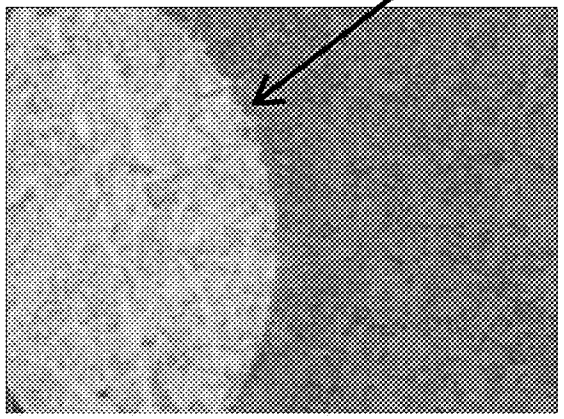
FIG. 4A to 4D are top views of a via in a stacked stripline circulator according to the disclosure.

Referring now to FIG. 4, a cross section view of the metallization layer 40 is shown disposed on substrate material 26. As can be seen from FIG. 4, metallization layer 40 comprises a protection layer 40*c*, a solderable barrier layer 40*b* and a copper layer 40*a*. Protection layer 40*c* comprises thin Au of thickness between 0.5 micron and 1.0 micron. Solderable barrier layer 40*b* comprises nickel (Ni) 2 to 4 microns thick or platinum (Pt) approximately 1 micron thick. The Cu conductor thickness varies between 10 microns and 20 microns depending on the application and frequency of operation.

Figure 4B:
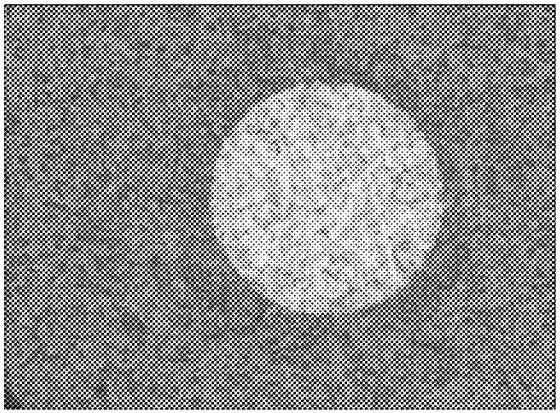
Figure 4C:
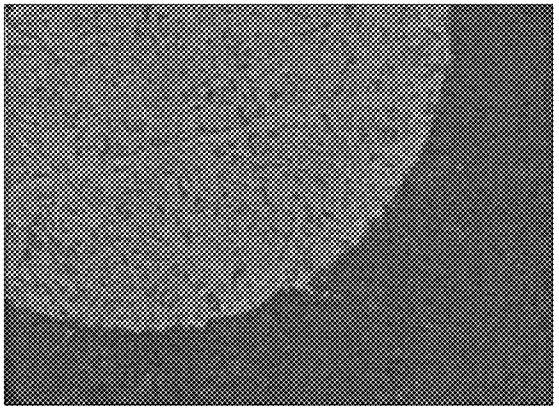
Figure 4D:
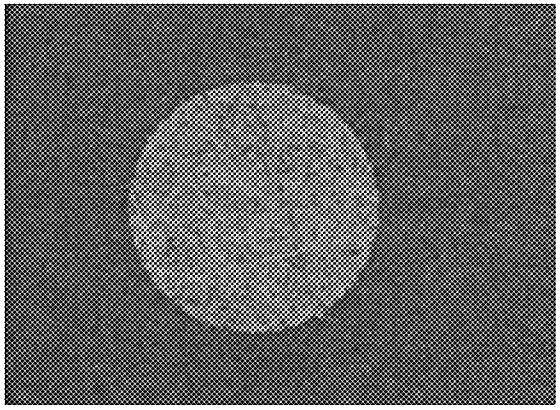

Referring now to FIGS. 4A to 4D, FIG. 4A is a top detailed view of a via connection through the substrate formed with copper wire showing the smooth glass to metal seal, FIG. 4B is a top view of a via formed with copper wire with a glass seal between the copper wire and the substrate; FIG. 4C is a top detailed view of a via connection through the substrate formed with Dumet wire sealed with glass; and 4D is a top view of a via formed with Dumet wire with a glass seal adjacent to the substrate.

Figure 5:
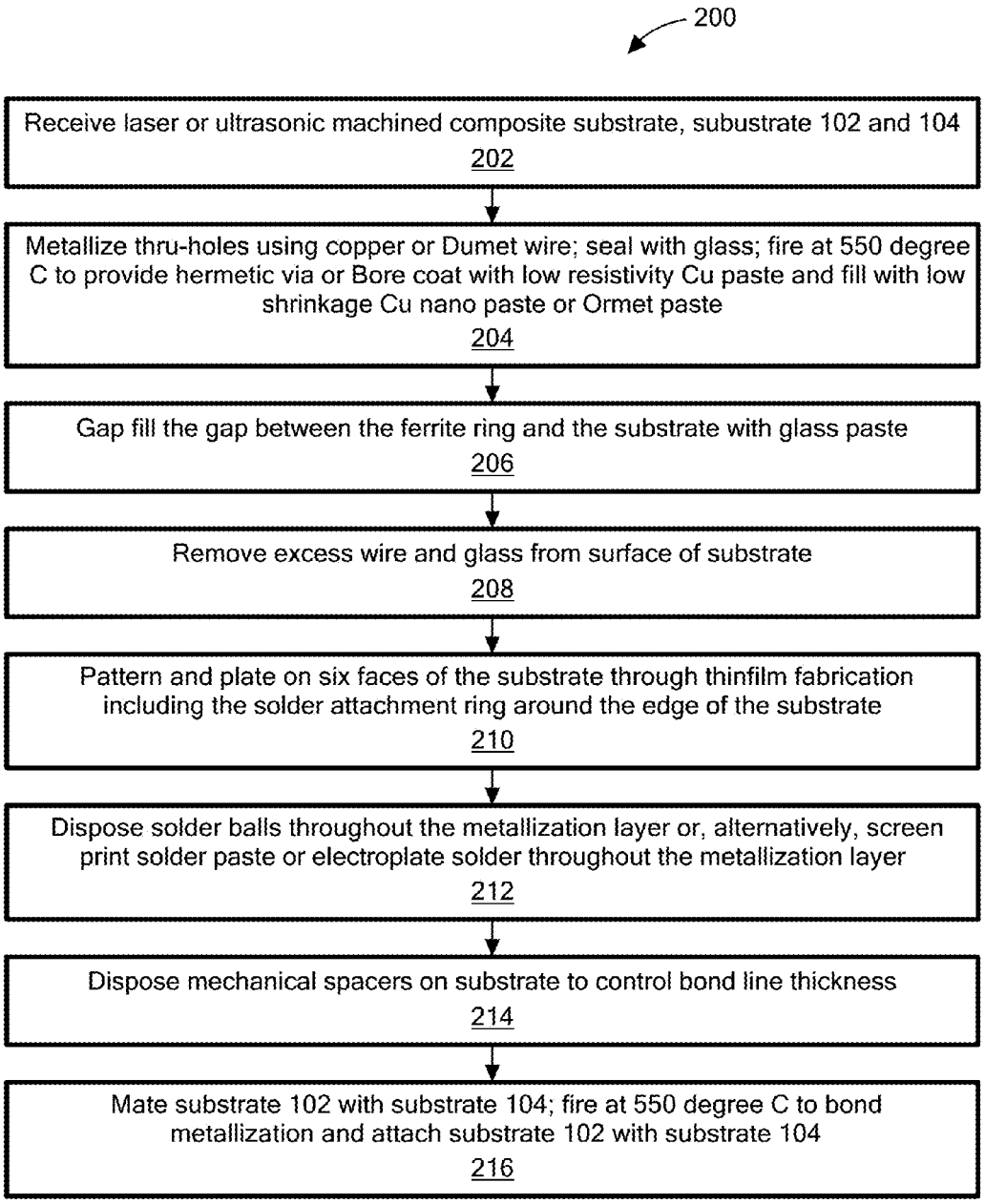
FIG. 5 is a diagram showing the various steps used to fabricate a stacked stripline circulator according to the disclosure.

Referring now to FIG. 5, a fabrication process 200 is shown to fabricate the stacked stripline circulator 100. First, a laser machined or ultrasonic machined composite substrate is received where the substrate includes a composite disc fabricated within the substrate as shown by step 202. Vertical ultrasonic machined edges provide advantages in substrate to substrate bonding. As described earlier in connection with FIG. 2, a substrate layer 102, 104 includes a disc 22 and a dielectric material 26 encircling the disc 22 with thru-holes formed in the substrate ready to accommodate metallization. Next, as shown in step 204, a copper or Dumet wire coated with glass is disposed in each thru-hole and fired at 550 degree C. to provide a hermetic sealed via 30 or alternatively a bore coat with low resistivity copper paste and fill with low shrinkage copper nano paste or Ormet paste is applied. The hermetic sealed via 30 is void free. As shown in step 206, the gap between disc 22 and dielectric material 26 is gap filled with glass paste such as ESL G481 or Aremco ceramic adhesives such as Aremoco 643-VF or Aremco 634-ZO among others. Any excess copper and glass is removed from the surface of the substrate as shown in step 20B. The substrate is cleaned and the thin film metallization Cu/Ni/Au is pattern plated to form the resonator structure, the matching network, the solder attachment ring on one side and the ground plane on the other side of the substrate as shown in step 210. During this step additional four edges of the substrate are also metalized with Cu/Ni/Au. Next, as shown in step 212, solder balls are disposed throughout the metallization layer or screen print solder paste or electroplate solder is disposed throughout the metallization layer. Alternately, the solder could be dispensed on selective regions only. Commercially available CuSn Ormet paste could also be screen printed on appropriate locations of the metalized pattern as an alternate to solder on Cu metallization. Next, mechanical spacers or stand offs are placed on the substrate to control bond line thickness to reduce variability in performance as shown in step 214. Next, as shown is step 216, the substrate 102 is mated with the substrate 104 where the mirrored patterns on the substrate are aligned to each other with a pick and place tool with temporary tacking and then reflowed and fired at <350 degree C. to bond the metallization of substrate 102 with the metallization of the substrate 104 with each other. Furthermore, the solder ring around the edge connects the substrate 102 with the substrate 104 as well as interconnects the ground planes on each substrate together through the edge metallization. AuSn and/or Pb/Sn among other solders could be used. Alternatively, compression bonding, diffusion bonding or adhesive bonding or other similar techniques can be used to bond the substrate 102 with the substrate 104. If Ormet paste is used then pressure is applied to transient liquid phase sintering of both substrates together and electroless Ni/Au is plated on the external surfaces of the substrate for protection.

To complete the stacked stripline circulator 100, pole pieces are placed on universal tape ring frame boats (not shown) and an adhesive is printed on each pole piece. A magnet is placed on the adhesive and the magnet assembly is cured in an oven. Next, the stack circulator assemblies are placed on universal tape ring frame boats and an adhesive is applied to each stacked circulator assembly. A magnet assembly (pole piece and magnet) is placed on each stacked circulator assembly and cured in an oven. Then the process is repeated to place a magnet assembly on the back side of each stacked circulator assembly. The latter steps provide a stacked stripline circulator 100 as shown in FIG. 1.

It should now be appreciated, a stacked stripline circulator 100 can be fabricated using less expensive materials and processes than using the techniques described in the above mentioned patent application Ser. No. 13/952,020. Here, less expensive copper is used for the metallization layer 40 and via fill 30 instead of gold and no later separate edge metallization step is needed to provide the edge metallization.

Figure 6:
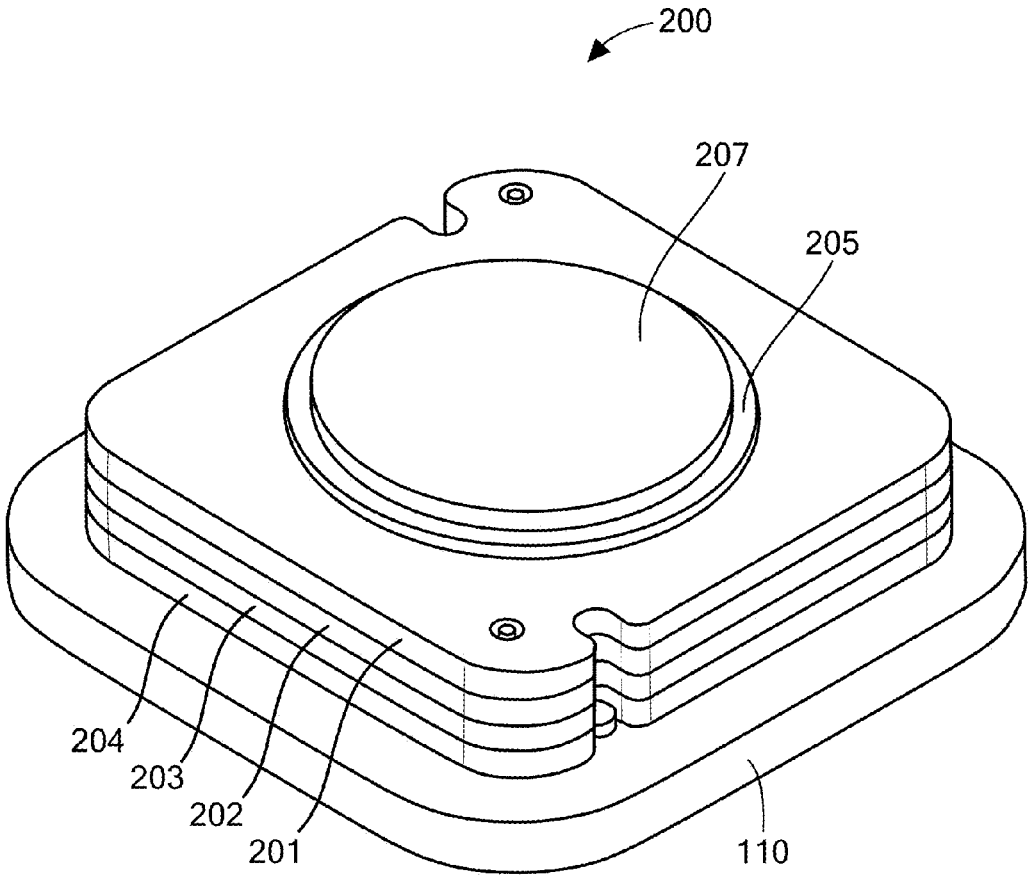
FIG. 6 is a top perspective view of a dual stacked stripline circulator according to the disclosure.

Having described the stacked stripline circulator 100, it should also be appreciated a dual stacked stripline circulator or other stacked circulator configurations can be fabricated using the techniques disclosed herein including 3-dimensional integration of substrates. For example, referring now to FIG. 6, a dual stacked stripline circulator 200 is shown where two stripline circulators fabricated as described herein are stacked on top of each other for use in the 0.5 to 20.0 GHz band. The dual stacked stripline circulator 200 includes four substrates, substrate 201, substrate 202, substrate 203 and substrate 204. A cold plate 110 is attached to substrate 204. Each circulator includes two substrates, substrate 201 and 202 forming a first circulator and substrate 203 and 204 forming a second circulator, for a total of four substrates stacked together to provide the dual stacked stripline circulator 200. A magnetic bias is provided by a magnetic pole piece 205 and permanent magnet 207 and a magnetic pole piece (not shown) and permanent magnet (not shown) positioned, respectively, on the top and the bottom of the stacked substrate assembly.

Figure 7:
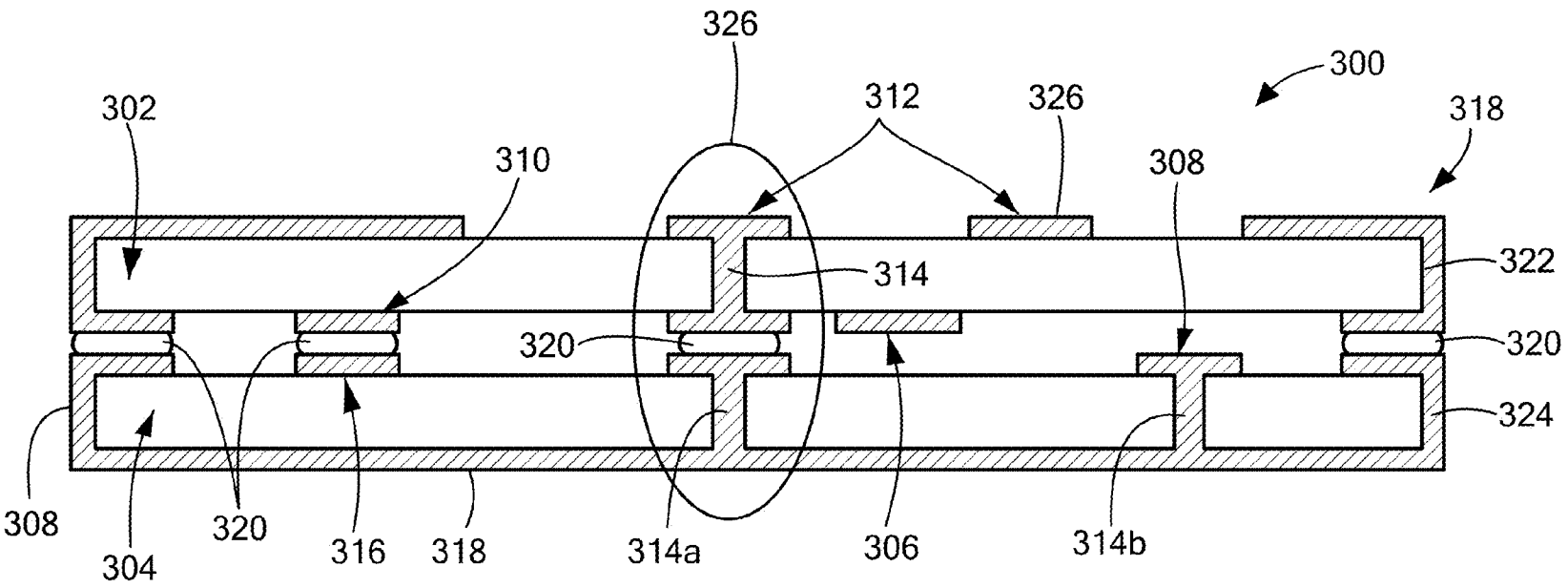
FIG. 7 is a side view of a stacked RF circuit according to the disclosure.

Referring now to FIG. 7, a stacked RF circuit 300 is shown to include a first RF substrate 302 and a second RF substrate 304 where multiple substrates can be stacked to form passive RF and DC circuit elements. The substrate material can include alumina, quartz, silicon, BeO, AlN, ferrites and garnet. A first metalized pattern 306 is disposed on the first RF substrate 302 to include stripline conductors 310 formed on one side of the first RF substrate 302 and conductors 312 formed on the other side of the first RF substrate 302 as shown using low loss copper (Cu), silver (Ag) or gold (Au) conductor material. A second metalized pattern 308 is disposed on the second RF substrate 304 to include stripline conductors 316 formed on one side of the second RF substrate 304 and a ground plane 318 formed on the other side of the second RF substrate 304 as shown using low loss copper (Cu), silver (Ag) or gold (Au) conductor material. The conductor material can be provided using low resistivity copper approaching the value of bulk resistivity of copper of 1.67 micro-ohms per centimeter. To connect conductor on front and back of the substrates 302 and 304 via through the substrate 314, 314*a* and 314*b* are is provided using low cost via fill formed with Cu wire, Cu paste, Ormet paste or Cu nano pastes. Edge metallization 322 is disposed on the edge of the substrate 302 and edge metallization 324 is disposed on the edge of the substrate 304 to connect the ground plane 318. Solder 320 is used to electrically and mechanically connect the substrates 302 and 304 as shown to form strip line 310, to connect edge metallization 322 to edge metallization 324 and provide signal path 326 through both substrates 302 and 304. In this manner strip line is formed, grounds are connected and signal path through both substrates are defined at the solder attachment step. The latter also provides an electrical connection to connect to the ground plane and provide a hermetic edge seal.

Figure 7A:
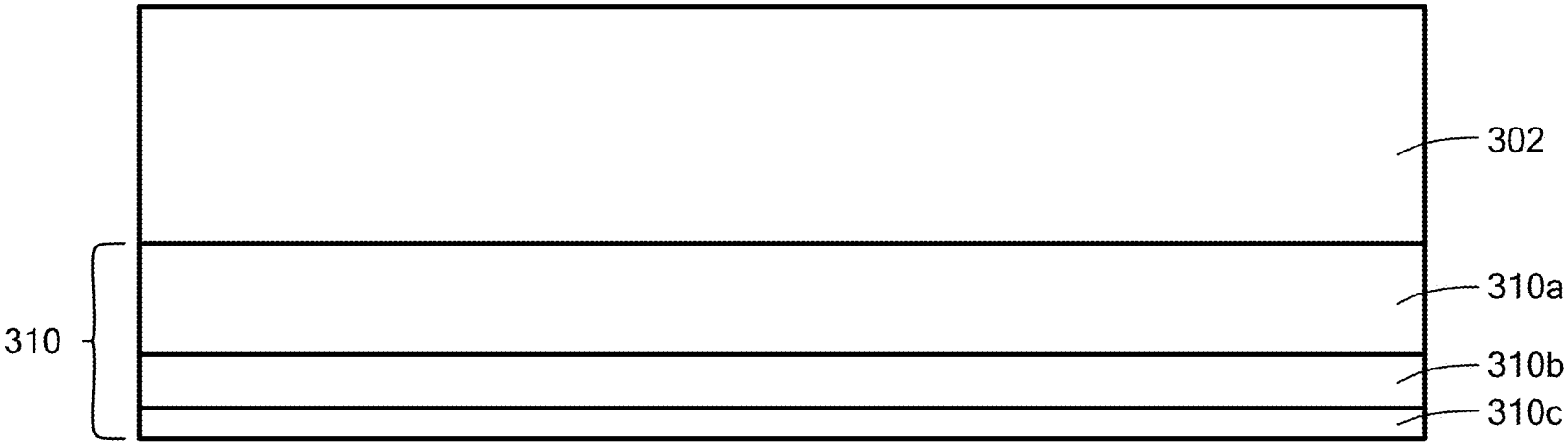
FIG. 7A is a cross sectional view of a portion of the stacked RF circuit according to the disclosure.

Referring now to FIG. 7A, a cross section view of the metallization layer 310 is shown disposed on substrate material 302. As can be seen from FIG. 7A, metallization layer 310 comprises a protection layer 310*c*, a solderable barrier layer 310*b* and a copper layer 310*a*. The protection layer 310*c* comprises thin Au of thickness between 0.5 micron and 1.0 micron. The solderable barrier layer 310*b* comprises nickel (Ni) 2 to 4 microns thick or platinum (Pt) approximately 1 micron thick.

A number of embodiments of the disclosure have been described. Nevertheless, it will be understood that various modifications may be made without departing from the spirit and scope of the disclosure. Accordingly, other embodiments are within the scope of the following claims.

What is claimed is:

1. A stacked stripline circulator comprising:
- a first ferrite disc;
- a second ferrite disc;
- a first substrate having a metalized edge with the first ferrite disc disposed in the first substrate;
- a second substrate having a metalized edge with the second ferrite disc disposed in the second substrate;
- a first metalized pattern layer defining ports of a circulator disposed on the first substrate, the first metalized pattern layer comprising a copper layer, a solderable barrier layer and a protection layer;
- a second metalized pattern layer defining ports of a circulator disposed on the second substrate, the second metalized pattern layer comprising a copper layer, a solderable barrier layer and a protection layer;
- a bond ring bonding the metalized edge of the first substrate with the metalized edge of the second substrate; and
- a bonding material that electrically and mechanically connects the metalized edge of the first substrate with the metalized edge of the second substrate.

2. The stacked stripline circulator as recited in claim 1 wherein the copper layer of the first metalized pattern layer and the copper layer of the second metalized pattern layer are each formed by plating low resistivity Cu, with bulk resistivity ranging between 1.67 microhm-cm to 1.9 microohm-cm.

3. The stacked stripline circulator as recited in claim 1 comprising a hermetic seal.

4. The stacked stripline circulator as recited in claim 1 comprising:
- a first permanent magnet;
- a second permanent magnet;
- a first pole piece disposed between the first permanent magnet and the first substrate; and
- a second pole piece disposed between the second permanent magnet and the second substrate.

5. The stacked stripline circulator as recited in claim 1 comprising a plurality of solder balls disposed between the first metalized pattern and the second metalized pattern.

6. The stacked stripline circulator as recited in claim 1 comprising a plurality of mechanical spacers disposed between the first substrate and the second substrate.

7. The stacked stripline circulator as recited in claim 1 wherein a metallization layer is provided on one surface of each of the substrates to provide the pattern defining a resonator, a matching network, signal via pads and coaxial ground via pads of three ports of a three-port circulator.

8. The stacked stripline circulator as recited in claim 1 wherein a ground plane metallization layer is provided on one surface of each of the substrates.

9. The stacked stripline circulator as recited in claim 1 wherein the substrate is one of any ceramic material including garnet, ferrite, titanate, BeO or alumina.

10. The stacked stripline circulator as recited in claim 1 comprising:
- third substrate having a metalized edge with a third ferrite disc disposed in the third substrate;
- a fourth substrate having a metalized edge with a fourth ferrite disc disposed in the fourth substrate;
- a third metalized pattern layer defining ports of a circulator disposed on the third substrate, the third metalized pattern layer comprising a copper layer, a solderable barrier layer and a protection layer;
- a fourth metalized pattern layer defining ports of a circulator disposed on the fourth substrate, the fourth metalized pattern layer comprising a copper layer, a solderable barrier layer and a protection layer; and
- a bond ring bonding the metalized edge of the third substrate with the metalized edge of the fourth substrate.

11. The stacked stripline circulator as recited in claim 1 comprising vias disposed in each of the substrates, the vias comprising copper.

12. The stacked stripline circulator as recited in claim 11 wherein the copper filled vias comprise bore coated copper paste and filled with ormet paste.

13. A stacked radio frequency (RF) circuit comprising:
- a first RF substrate;
- a second RF substrate;
- the first RF substrate having a first metalized pattern layer defining ports of a RF circuit disposed on the first RF substrate, the first metalized pattern layer comprising low resistivity copper conductor with a solderable barrier layer and a protection layer;
- the second RF substrate having a second metalized pattern layer defining ports of a RF circuit disposed on the second RF substrate, the second metalized pattern layer comprising a copper layer, a solderable barrier layer and a protection layer; and solder, dispensed on the substrates, connecting electrically and mechanically the RF circuit disposed on the first RF substrate with the RF circuit disposed on the second substrate.

14. The stacked radio frequency (RE) circuit as recited in claim 13 comprising:

a third RF substrate;

a fourth RF substrate;

the third RF substrate having a third metalized pattern layer defining ports of a RF circuit disposed on the third RF substrate, the third metalized pattern layer comprising low resistivity copper conductor with a solderable barrier layer and a protection layer;

the fourth RF substrate having a fourth metalized pattern layer defining ports of a RF circuit disposed on the fourth RF substrate, the fourth metalized pattern layer comprising a copper layer, a solderable barrier layer and a protection layer; and solder, dispensed on the substrates, connecting electrically and mechanically the RF circuit disposed on the third RF substrate with the RF circuit disposed on the fourth substrate.

15. A method of providing a stacked stripline circulator comprising:

employing a first ferrite disc;

employing a second ferrite disc;

employing a first substrate having a metalized edge with the first ferrite disc disposed in the first substrate;

employing a second substrate having a metalized edge with the second ferrite disc disposed in the second substrate;

employing a first metalized pattern layer defining ports of a circulator disposed on the first substrate, the first metalized pattern layer comprising a copper layer, a solderable barrier layer and a protection layer;

employing a second metalized pattern layer defining ports of a circulator disposed on the second substrate, the second metalized pattern layer comprising a copper layer, a solderable barrier layer and a protection layer;

employing a bond ring bonding the metalized edge of the first substrate with the metalized edge of the second substrate; and employing a bonding material that electrically and mechanically connects the metalized edge of the first substrate with the metalized edge of the second substrate.

16. The method as recited in claim 15 wherein the copper layer of the first metalized pattern layer and the copper layer of the second metalized pattern layer are each formed by plating low resistivity Cu, with bulk resistivity ranging between 1.67 microhm-cm to 1.9 microohm-cm.

17. The method as recited in claim 15 comprising employing a hermetic seal.

18. The method as recited in claim 15 comprising:

employing a first permanent magnet;

employing a second permanent magnet;

employing a first pole piece disposed between the first permanent magnet and the first substrate; and employing a second pole piece disposed between the second permanent magnet and the second substrate.

19. The method as recited in claim 15 comprising employing a plurality of solder balls disposed between the first metalized pattern and the second metalized pattern.

20. The method as recited in claim 15 comprising employing a plurality of mechanical spacers disposed between the first substrate and the second substrate.

21. The method as recited in claim 15 comprising providing a metallization layer on one surface of each of the substrates to provide the pattern defining a resonator, a matching network, signal via pads and coaxial ground via pads of three ports of a three-port circulator.

22. The method as recited in claim 15 comprising providing a ground plane metallization layer on one surface of each of the substrates.

23. The method as recited in claim 15 comprising employing vias disposed in each of the substrates, the vias comprising copper.

24. The method as recited in claim 23 wherein the copper filled vias comprise bore coated copper paste and filled with ormet paste.

25. The method as recited in claim 15 wherein the substrate is one of any ceramic material including garnet, ferrite, titanate, BeO or alumina.

26. The method as recited in claim 15 comprising:

employing third substrate having a metalized edge with a third ferrite disc disposed in the third substrate;

employing a fourth substrate having a metalized edge with a fourth ferrite disc disposed in the fourth substrate;

employing a third metalized pattern layer defining ports of a circulator disposed on the third substrate, the third metalized pattern layer comprising a copper layer, a solderable barrier layer and a protection layer;

employing a fourth metalized pattern layer defining ports of a circulator disposed on the fourth substrate, the fourth metalized pattern layer comprising a copper layer, a solderable barrier layer and a protection layer; and employing a bond ring bonding the metalized edge of the third substrate with the metalized edge of the fourth substrate.

* * * * *